US005299407A

United States Patent [19]

Schuttler et al.

[11] Patent Number: 5,299,407

[45] Date of Patent: Apr. 5, 1994

[54] PROCESS AND DEVICE FOR AVOIDING STRAPPING-CAUSED DOWNTIME ON MACHINE FOR STRAPPING PACKAGES

[75] Inventors: Karl H. Schuttler; Karl Schurig, both of Remscheid, Fed. Rep. of Germany

[73] Assignee: Signode Bernpak GmbH, Remscheid-Lennep, Fed. Rep. of Germany

[21] Appl. No.: 928,586

[22] Filed: Aug. 13, 1992

[30] Foreign Application Priority Data

Nov. 26, 1991 [DE] Fed. Rep. of Germany ..... 4138800

[51] Int. Cl.[5] ..... B65B 13/04

[52] U.S. Cl. ..... 53/399; 53/64; 53/168; 53/389.2; 53/589; 100/26; 100/29; 100/33 PB; 242/58

[58] Field of Search ..... 100/26, 29, 33 PB; 53/64, 168, 399, 582, 589, 505, 506, 389.2, 389.3, 389.4; 242/58

[56] References Cited

U.S. PATENT DOCUMENTS

| | | | |
|---|---|---|---|
| 2,915,003 | 12/1959 | Crosby et al. . | |
| 3,029,571 | 4/1962 | Douthit | 53/168 |
| 3,325,071 | 6/1967 | Schmitz | 53/168 X |
| 3,983,774 | 10/1976 | Seragnoli | 53/64 X |
| 4,137,788 | 2/1979 | Fischer . | |
| 4,351,463 | 9/1982 | Knecht . | |
| 4,509,415 | 4/1985 | Stobb | 53/399 X |
| 4,691,498 | 9/1987 | Stamm . | |
| 4,724,659 | 2/1988 | Mori et al. . | |
| 4,885,901 | 12/1989 | Sakaki et al. | 53/589 |
| 4,955,180 | 9/1990 | Sakaki et al. | 53/399 |
| 5,079,899 | 1/1992 | Kurachi | 53/399 |

FOREIGN PATENT DOCUMENTS

| | | | |
|---|---|---|---|
| 0195345 | 9/1990 | European Pat. Off. . | |
| 2435441 | 2/1975 | Fed. Rep. of Germany | 53/168 |
| 2559376 | 9/1976 | Fed. Rep. of Germany . | |
| 118037 | 3/1978 | Fed. Rep. of Germany . | |
| 2741711 | 4/1978 | Fed. Rep. of Germany . | |
| 2837164 | 3/1980 | Fed. Rep. of Germany . | |
| 157086 | 10/1982 | Fed. Rep. of Germany . | |
| 3825668 | 2/1990 | Fed. Rep. of Germany . | |
| 3019929 | 12/1991 | Fed. Rep. of Germany . | |
| 1-213107 | 8/1989 | Japan . | |
| WO9107340 | 5/1991 | PCT Int'l Appl. . | |

*Primary Examiner*—John Sipos
*Assistant Examiner*—Daniel Moon
*Attorney, Agent, or Firm*—Schwartz & Weinrieb

[57] ABSTRACT

The invention concerns a process and a device for avoiding interruptions of operation caused by the strapping, on machines for the strapping of packing elements. The process is characterized by a second strapping coil with further strapping, and in that the leader of one of the two strappings is constantly kept at a standby position in the machine from which, upon removal of the other strapping from the strapping guideway, it is automatically fed to the strapping guideway. The device is characterized in that the feed system is preceded by a switch with two strapping guideways for a leader section for each one of the two strappings, with a strapping feed for the alternative introduction of one of the two strapping leaders into the feed system. A first drive system is provided within the vicinity of the strapping guideways for selectively introducing one of the strapping materials into the feed system, while a second drive system is provided within the vicinity of the supply coils of the strapping materials for selectively engaging one of the supply coils in order to retract or withdraw a damaged or depleted strapping material from the feed system and permit a second one of the strapping materials to be introduced into the feed system.

15 Claims, 2 Drawing Sheets

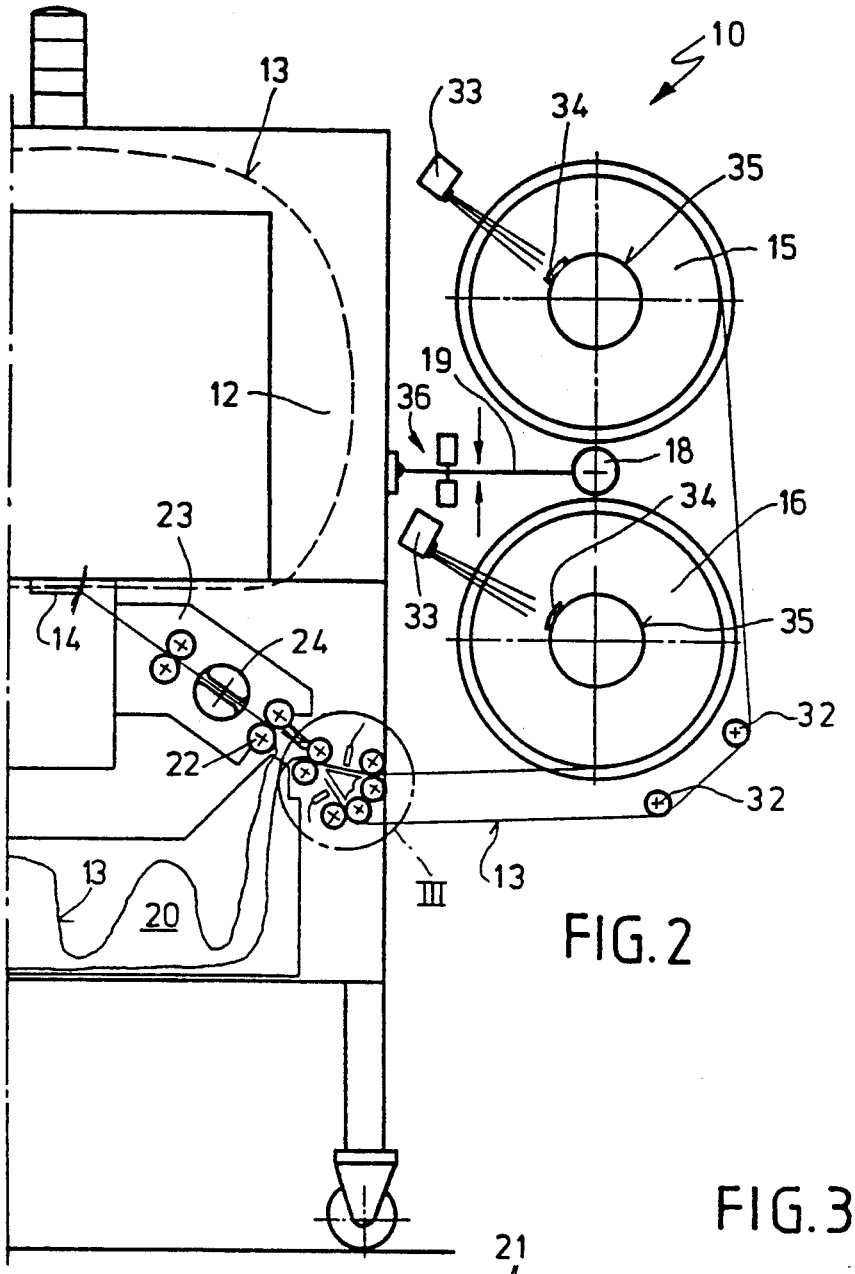
FIG. 2
FIG. 3
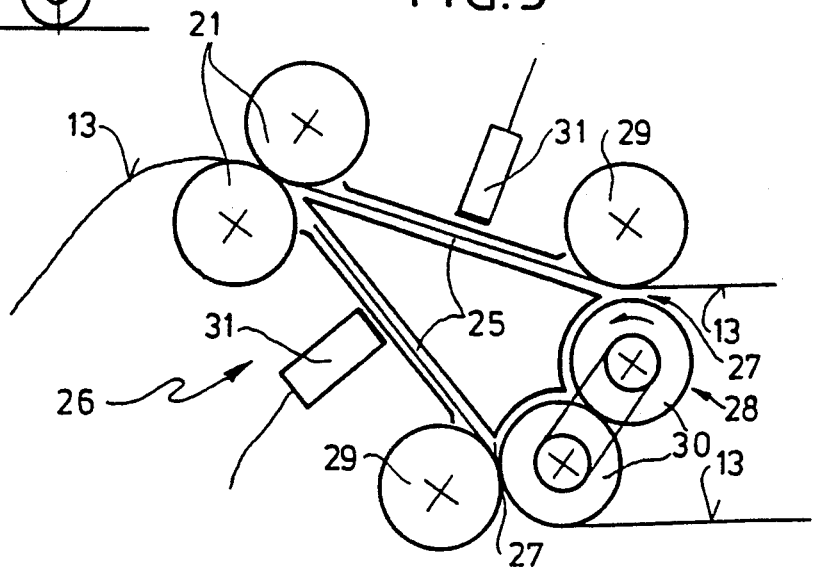

PROCESS AND DEVICE FOR AVOIDING STRAPPING-CAUSED DOWNTIME ON MACHINE FOR STRAPPING PACKAGES

FIELD OF THE INVENTION

The invention generally relates to strapping machines or systems, and more particularly is directed toward an apparatus and a process for avoiding strappingcaused downtime on machines for the strapping of packages, where the strapping material is stored on a supply coil.

BACKGROUND OF THE INVENTION

A process for the elimination or prevention of strapping-caused downtime on such machines is known from DE-PS 38 25 668. In this patent, the strapping—primarily thermoplastic synthetic strap or also steel band—contained in the machine is, in case of trouble, pulled out of the machine in a direction opposite to the feed direction of the strapping, by running the strapping coil in reverse. Therefore, in eliminating a strapping-caused malfunction, it is not necessary to perform any repair or corrective work upon the machine, but the strapping can be more swiftly prepared for re-insertion into the machine as a result of repair work performed upon the strapping material outside the machine. Thus, this process shortens a machine breakdown in time respects.

This prior process has proved itself extremely well. However, the duration of the work to be performed outside the machine in conjunction with eliminating damaged spots on the strapping can hardly be influenced, except for the skill applied in doing the manual work, so that corresponding machine downtime must be accepted.

OBJECT OF THE INVENTION

It is therefore a primary objective underlying the invention to provide a process for avoiding strapping-caused interruptions, which process enables in simple fashion a considerable further shortening of the duration of such interruptions.

SUMMARY OF THE INVENTION

The present invention solves the aforenoted problem through a process which is characterized by the provision of a further coil of strapping and in that the leader of one of the strappings is constantly kept ready in the machine in waiting position, from which, upon removal of the other strapping from the strapping guideway, it is automatically fed, as the case may be, into the strapping guideway.

According to the inventive process, the machine can in the event of a strapping-caused interruption automatically pull the damaged strapping out of the machine and continue its operation, without operator intervention, with the second strapping.

Interruptions caused by the strapping now need to last only up until the strapping contained in the machine has been pulled out of the machine because—once this has taken place—the strapping leader of the further strapping already disposed at the waiting position can be automatically fed to the strapping guideway. This shortens the duration of the interruption by the time which otherwise was necessary for repairing the strapping leader. During this time, which is still need to repair the originally damaged strapping, the machine already operates with the second strapping. Additionally, this has the advantage that the person performing the work on the damaged strapping may allow himself sufficient time for performing the job with particular care.

A strapping-caused interruption may also, occur when the strapping supply of a coil is depleted. Here, the inventive process results in the same advantages, because a new strapping coil can during the operation of the other strapping be installed and placed in its inventive standby position.

It is basically already known to store a second strapping coil at a reserve strapping station. But the strapping of that coil is contained exclusively on the coil and is in no specific arrangement operatively related to the strapping system; when needed, the strapping needs to be unwound from each supply in an unwieldy and time-consuming fashion, just as before, and fed to the machine. Therefore, this prior art merely provides for a strapping supply to be kept near the machine.

The invention also concerns a machine for the strapping of goods to be packed, with a rotatably driven and, as the case may be, breakable strapping coil, and with a feed system for the strapping. The objective is to provide a machine whose capacity is increased due to, in time respects, minimized interruptions caused by the strapping.

The invention solves the aforenoted problems by arranging before the feed system a switch with two strapping guideways, each for a leader of the two strappings, and with a strapping feed for alternative introduction of one of the two strapping leaders into the feed system.

The switch controls the two strappings in such a way that—depending on the switch position—one of the two strappings is gripped by the feed system while the other, standing by, waits to be used. Thus, the invention has the particular advantage that upon occurrence of an interruption, as a result of a defect or disturbance of the run of the one strapping, the packing cycle can be continued immediately, that is, upon removal of the first strapping from the machine, and with the lead section of the second strapping introduced into the strapping feed. Besides, the switch ensures by means of its controllability that the leader of the one strapping, merely "held in reserve," cannot inadvertently proceed into the path of the strapping which is in use.

In accordance with a preferred embodiment of the invention, the switch preceding the feed system is so arranged that the two strapping guideways converge from two spatially separated entrance gaps toward the feed system while the strapping feed is arranged near the strapping entrance gaps. The advantage of this is that the strapping leaders only need to be pushed a short distance into the strapping guideways for being fed, when needed, by the strapping feed directly into the feed system.

In a particularly preferred embodiment, the strapping feed—as the case may be, from an operationally neutral position—acts alternatively on the strapping contained in the one or on that contained in the other strapping guideway. Therefore, by means of only a single strapping feed, the respective one of the strapping leaders in the strapping guideways is in favorable fashion moved into the feed system.

BRIEF DESCRIPTION OF THE DRAWINGS

Various other objects, features, and attendant advantages of the present invention will become more fully appreciated from the following description of the invention, with the aid of an embodiment illustrated in the accompanying drawings, in which like reference characters designate like or corresponding parts throughout the several views, and wherein:

FIG. 2 is a section of FIG. 1, where the two strapping coils have been rotated 90°, and FIG. 3 is an enlarged illustration of the area of the machine circled in FIG. 2.

DETAILED DESCRIPTION OF THE ILLUSTRATED EMBODIMENTS

Figure 1:
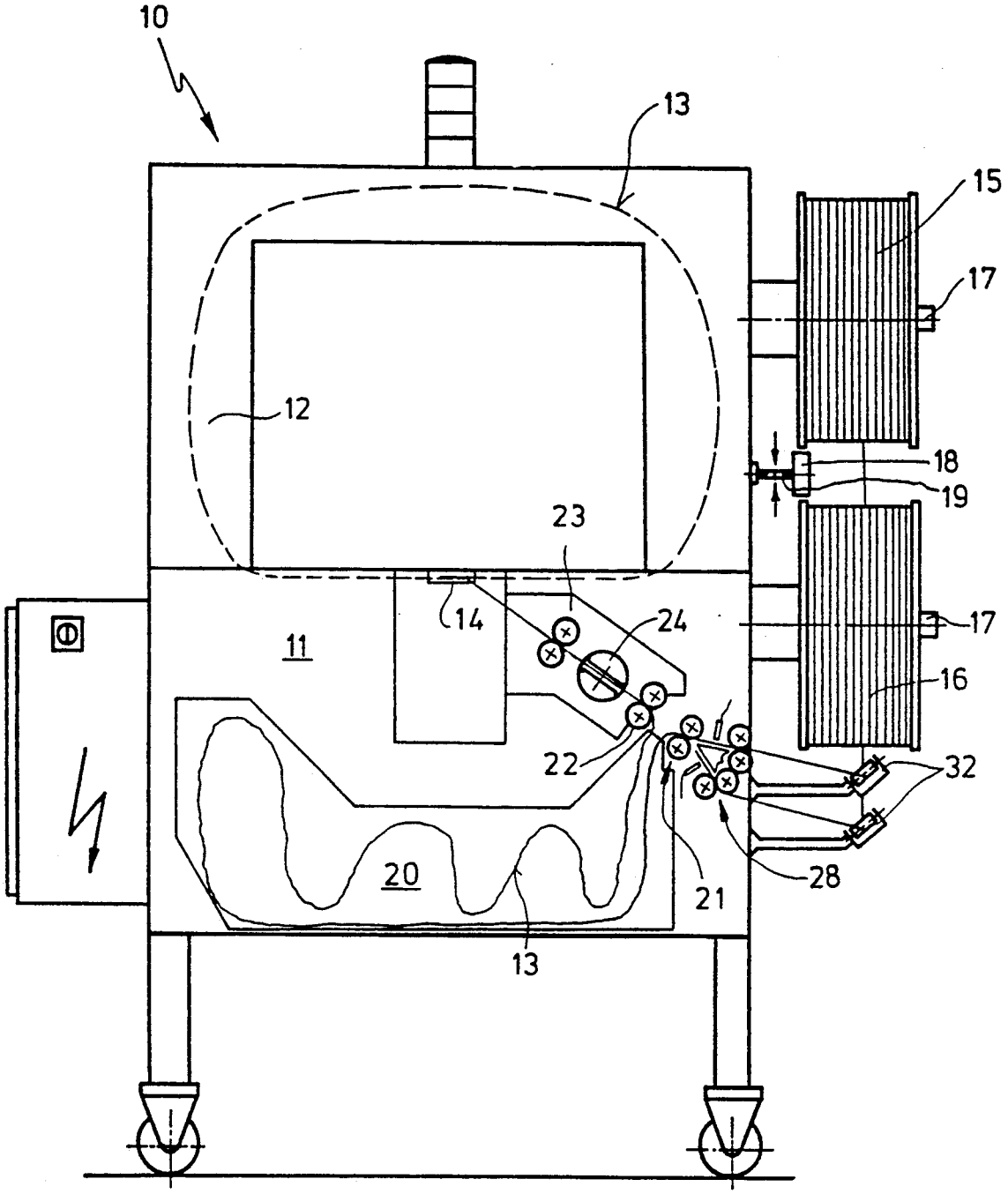
FIG. 1 is a schematic view of a machine for strapping goods to be packed.

Contained on the machine housing 11 on a strapping machine referenced 10 overall is an essentially sealed strapping guide channel 12 through which, and around a packing element (not shown), a strapping 13 is fed to a sealing unit 14.

The strapping 13—normally a band of thermoplastic material or steel—is kept in supply outside the machine housing 11 on two strapping coils 15 and 16, which are rotatably mounted on shafts or axles 17 arranged horizontally on the machine housing 11. Arranged between the strapping coils 15 and 16, as well on the machine housing 11 and on a pivot arm 19, is a drive 18 coordinated with the coils.

Referenced 20 is a strapping receiver, which in the embodiment is fashioned as a box type receiver, with an inside clearance which is only slightly larger than the strapping 13 is wide. The strapping 13 is fed into the strapping receiver 20 with the aid of receiver fill feed rolls 21. Arranged behind the strapping receiver 20, forwardly in the feed direction of the strapping, are strapping retraction rolls 22 which, in turn, are preceded by strapping thrust rolls 23. The rollers 21, 22 and 23 are fashioned as roller pairs driving the strapping by friction. Referenced 24 is a strapping tensioner, which here does not play a particular role.

Arranged in front of the feed rolls 21 is a switch 26 which comprises two strapping guideways 25. While the strapping guideways 25 converge in the area of the feed rolls 21, their exposed rear ends form the strapping entrance gaps 27 for the two strappings 13. Arranged in the area of the entrance gaps 27 is a strapping feed 28 comprised of two spatially fixed rolls 29 and two pivotal rolls 30 which are coupled to one another in the fashion of a belt drive. Coordinated with each strapping guideway 25, between the feed rolls 21 and the device 28, is a strapping sensor 31. Moreover, a reversing roll 32 is mounted on the machine housing 11, between each strapping coil 15, 16 and the pertaining entrance gap 27.

As FIG. 2 shows, a photoelectric cell 33 is coordinated with each strapping coil 15, 16. Shown schematically at 34 is a reflective surface on the strapping core 35, which may be formed by the core material itself.

The first-time operation of the strapping machine 10 proceeds as follows. To begin with, the two leader sections of the strapping 13 are threaded through the reversing rolls 32 and inserted in the entrance gaps 27. Upon starting the machine, the leader of one strapping is pushed by the strapping feed 28, through one of the strapping guideways, between the receiver fill feed rolls 21. Next, the receiver fill feed rolls 21 surrender the strapping 13 to the strapping retraction rolls 22, which at appropriate direction of rotation feed the strapping 13 through the tensioning device 24 and the strapping thrust rolls 23 to the sealing unit 14.

In a next step, due to the back-up pressure created, the receiver 20 is filled by means of the feed rolls 21 with at least the strapping length necessary for the following strapping operation. The back-up pressure is created by retaining the strapping leader in the sealing unit 14 while the receiver fill feed rolls 21 continue to feed. Next, the strapping thrust rolls 23 feed the strapping leader at high speed through the strapping channel 12, with the front end of the strapping being clamped down in the area of the sealing unit. The strapping 13 is then tightened around the packing element by means of the strapping retraction rolls 22, the overlapping strapping sections are joined by the sealing unit 14 and, finally, the strapping is cut off. A new strapping cycle can begin thereafter.

If disturbances now occur which are caused by the strapping, the damaged strapping section is moved out of the machine 10. This takes place in that the strapping coil 15 or 16, from which the strapping 13 is presently being unwound, is driven with the aid of the drive 18 (rewinder) in a direction opposite to the operationally given direction of rotation. To enable the alternative driving of both strapping coils 15, 16 in the direction opposite to the regular direction of rotation, the drive 18 is mounted on a pivot arm 19 which by solenoids 36 arranged on both sides thereof can be moved in such a way that it engages either the strapping coil 15 or 16 assumes a neutral middle position.

During the pullback of the strapping 13, the strapping sensor 31 coordinated with a strapping guideway 25—once the end of the strapping has passed—automatically causes the start of the strapping feed 28, whereby the strapping leader of the strapping 13 contained on the other strapping coil 15 or 16 is advanced through the other strapping guideway 25 to the receiver fill feed rolls 21. Next, the packing cycle described above can immediately be continued with the "reserve band." Downtime caused by the strapping is considerably shortened thereby.

The process and the device also act accordingly as the strapping supply is being depleted. For instance, as the upper strapping coil 15 is the drawing, the strapping of which is presently being used, is depleted, the reflective performance regarding the respective photoelectric cell 33 changes as soon as its beam changes over from the band to the strapping core 35. This "strapping end ensing" leads to the retraction of the strapping 13 out of the machine 10. As soon as the respective strapping sensor 31 then signals its guideway 25 as being empty, the strapping feed 28 changes over to the second strapping 13, presenting it to the strapping feed apparatus. Consequently, nearly no machine standstill occurs either upon depletion of the strapping 13 of one strapping supply.

Obviously, many modifications and variations of the present invention are possible in light of the above teachings. It is therefore to be understood that within the scope of the appended claims, the present invention may be practiced otherwise than as specifically described herein.

We claim:

1. A method for avoiding downtime interruptions of strapping operations upon strapping machines for strapping package elements, comprising the steps of:

providing a first supply coil of strapping material;
providing a second supply coil of strapping material;
providing a first flow path for a first strapping material wound upon said first supply coil and leading from said first supply coil to a strapping sealing unit;
providing a second flow path for a second strapping material wound upon said second supply coil and leading from said second supply coil to said strapping sealing unit;
driving one of said first and second strapping materials, by a first drive means which is selectively engageable with said first and second strapping materials, in a forward direction along a respective one of said first and second flow paths from a respective one of said first and second supply coils to said strapping sealing unit;
driving said respective one of said first and second supply coils, by a second drive means which is selectively engageable with said first and second supply coils, in a reverse direction so as to retract said one of said first and second strapping materials out from said respective one of said first and second flow paths when a flow disturbance occurs along said respective one of said first and second flow paths during forward driving of said one of said first and second strapping materials along said respective one of said first and second flow paths; and
sensing a leading end portion of said one of said first and second strapping materials, by a sensing switch means, as said one of said first and second strapping materials is withdrawn from said respective one of said first and second flow paths as a result of said driving of said selected one of said first and second supply coils in said reverse direction by said second drive means in consequence of said occurrence of said flow disturbance along said respective one of said first and second flow paths, and actuating said first drive means such that said first drive means engages the other one of said first and second strapping materials so as to drive said other one of said first and second strapping materials in said forward direction along the other one of said first and second flow paths when said sensing switch means senses said withdrawal of said one of said first and second strapping materials from said respective one of said first and second flow paths,
whereby downtime interruption of said strapping operation, due to said disturbance occurring along said respective one of said first and second flow paths, is minimized.

2. A method for avoiding downtime interruptions of strapping operations upon strapping machines for strapping package elements, comprising the steps of:
providing a first supply coil of strapping material;
providing a second supply coil of strapping material;
providing a first flow path for a first strapping material wound upon said first supply coil and leading from said first supply coil to a strapping sealing unit;
providing a second flow path for a second strapping material wound upon said second supply coil and leading from said second supply coil to said strapping sealing unit;
driving one of said first and second strapping materials, by a first drive means which is selectively engageable with said first and second strapping materials, in a forward direction along a respective one of said first and second flow paths from a respective one of said first and second supply coils to said strapping sealing unit;
providing a second drive means which is selectively engageable with said first and second supply coils for driving said respective one of said first and second supply coils in a reverse direction so as to retract said one of said first and second strapping materials out from said respective on of said first and second flow paths when said one of said first and second strapping materials is depleted upon said respective one of said first and second supply coils;
sensing depletion of said one of said first and second strapping materials, by a first sensing switch means, upon said respective one of said first and second supply coils, and actuating said second drive means for driving said respective one of said first and second supply coils in said reverse direction so as to retract said one of said first and second strapping materials out from said respective one of said first and second flow paths; and
sensing a leading end portion of said one of said first and second strapping materials, by a second sensing switch means, as said one of said first and second strapping materials is withdrawn from said respective one of said first and second flow paths as a result of said driving of said respective one of said first and second supply coils in said reverse direction by said second drive means in response to said sensing of said depletion of said one of said first and second strapping materials upon said respective one of said first and second supply coils, and actuating said first drive means such that said first drive means engages the other one of said first and second strapping materials so as to drive said other one of said first and second strapping materials in said forward direction along the other one of said first and second flow paths when said second sensing switch means senses said withdrawal of said leading end portion of said one of said first and second strapping materials from said respective one of said first and second flow paths,
whereby downtime interruption of said strapping operation, due to said depletion of said one of said first and second strapping materials upon said respective one of said first and second supply coils, is minimized.

3. Apparatus for strapping package elements, comprising:
a first supply coil of strapping material;
a second supply coil of strapping material;
a first flow path for a first strapping material wound upon said first supply coil and leading from said first supply coil to a strapping sealing unit;
a second flow path for a second strapping material wound upon said second supply coil and leading from said second supply coil to said strapping sealing unit;
first drive means selectively engageable with said first and second strapping materials for driving a selected one of said first and second strapping materials in a forward direction along a respective one of said first and second flow paths from a respective one of said first and second supply coils to said strapping sealing unit;

second drive means selectively engageable with said first and second supply coils for driving a selected one of said first and second supply coils in a reverse direction so as to retract one of said first and second strapping materials out from a respective one of said first and second flow paths when a flow disturbance occurs along said respective one of said first and second flow paths during forward driving of said one of said first and second strapping materials along said respective one of said first and second flow paths; and sensing switch means for sensing a leading end portion of said one of said first and second strapping materials as said one of said first and second strapping materials is withdrawn from said respective one of said first and second flow paths as a result of said driving of said selected one of said first and second supply coils in said reverse direction in response to said occurrence of said flow disturbance along said respective one of said first and second flow paths, and for actuating said first drive means such that said first drive means engages the other one of said first and second strapping materials so as to drive said other one of said first and second strapping materials in said forward direction along the other one of said first and second flow paths when said sensing switch means senses said withdrawal of said one of said first and second strapping materials from said respective one of said first and second flow paths whereby downtime interruption of said strapping operation, due to said disturbance occurring along said respective one of said first and second flow paths, is minimized.

4. Apparatus as set forth in claim 3, wherein:

said first and second flow paths comprise two convergent flow paths having separate, first and second inlet portions, and a single outlet portion.

5. Apparatus as set forth in claim 4, wherein said first drive means comprises:

first and second fixed drive rolls respectively disposed within the vicinity of said first and second inlet portions of said first and second flow paths; and third and fourth drive rolls comprising a single assembly pivotable between first and second positions whereby said third and fourth drive rolls can respectively cooperate with said first and second fixed drive rolls for respectively driving said first and second strapping materials along said first and second flow paths.

6. Apparatus as set forth in claim 3, wherein:

said sensing switch means comprises a pair of sensors respectively disposed along said first and second flow paths for respectively sensing leading portions of said first and second strapping materials.

7. Apparatus as set forth in claim 3, wherein:

said second drive means comprises a single drive roller interposed between said first and second supply coils.

8. Apparatus as st forth in claim 7, wherein:

said single drive roller is mounted upon a free end of an arm pivotably mounted upon a housing portion of said apparatus; and a pair of solenoids are operatively disposed upon opposite sides of said arm for pivotably moving said arm in one of two opposite directions as said pair of solenoids are selectively energized so as to selectively engage said single drive roller of said second drive means with said first and second supply coils.

9. Apparatus for strapping package elements, comprising:

a first supply coil of strapping material;

a second supply coil of strapping material;

a first flow path for a first strapping material wound upon said first supply coil and leading from said first supply coil to a strapping sealing unit;

a second flow path for a second strapping material wound upon said second supply coil and leading from said second supply coil to said strapping sealing unit;

a first drive means selectively engageable with said first and second strapping materials for driving a selected one of said first and second strapping materials in a forward direction along a respective one of said first and second flow paths from a respective one of said first and second supply coils to said strapping sealing unit;

a second drive means selectively engageable with said first and second supply coils for driving a selected one of said first and second supply coils in a reverse direction so as to retract one of said first and second strapping materials out from a respective one of said first and second flow paths when said one of said first and second strapping materials is depleted upon said selected one of said first and second supply coils;

a first sensing switch means for sensing depletion of said one of said first and second strapping materials upon said selected one of said first and second supply coils, and for actuating said second drive means for driving said selected one of said first and second supply coils in said reverse direction so as to retract said one of said first and second strapping materials out from said respective one of said first and second flow paths; and second sensing switch means for sensing a leading end portion of said one of said first and second strapping materials as said one of said first and second strapping materials is withdrawn from said respective one of said first and second flow paths as a result of said driving of said selected one of said first and second supply coils in said reverse direction in response to said sensing of said depletion of said one of said first and second strapping materials upon sad selected one of said first and second supply coils, and for actuating said first drive means such that said first drive means engages the other one of said first and second strapping materials so as to drive said other one of said first and second strapping materials in said forward direction along the other one of said first and second flow paths when said second sensing switch means senses said withdrawal of said one of said first and second strapping materials from said respective one of said first and second flow paths whereby downtime interruption of said strapping operation, due to said depletion of said one of said first and second strapping materials upon said selected one of said first and second supply coils, is minimized.

10. Apparatus as set forth in claim 9, wherein:

said first and second flow paths comprise two convergent flow paths having separate, first and second inlet portions, and a single outlet portion.

11. Apparatus as set forth in claim 10, wherein said first drive means comprises:

first and second fixed drive rolls respectively disposed within the vicinity of said first and second inlet portions of said first and second flow paths; and third and fourth drive rolls comprising a single assembly pivotable between first and second positions whereby said third and fourth drive rolls can respectively cooperate with said first and second fixed drive rolls for respectively driving said first and second strapping materials along said first and second flow paths.

12. Apparatus as set forth in claim 9, wherein said first sensing switch means comprises:

a reflective element disposed upon a core portion of each one of first and second strapping material supply rolls upon which said first and second strapping material supply coils are wound; and a photoelectric cell disposed externally of an outer peripheral portion of each one of said first and second strapping material supply rolls for detecting said reflective element of one of said first and second strapping material supply rolls when said one of said first and second strapping material supply rolls is depleted of said respective first and second strapping material.

13. Apparatus as set forth in claim 9, wherein said second sensing switch means comprises:

a pair of sensors respectively disposed along said first and second flow paths for respectively sensing leading portions of said first and second strapping materials.

14. Apparatus as set forth in claim 9, wherein said second drive means comprises:

a single drive roller interposed between said first and second supply coils.

15. Apparatus as set forth in claim 14, wherein:

said single drive roller is mounted upon a free end of an arm pivotably mounted upon a housing portion of said apparatus; and a pair of solenoids are operatively disposed upon opposite sides of said arm for pivotably moving said arm in one of two opposite directions as said pair of solenoids are selectively energized so as to selectively engage said single drive roller of said second drive means with said first and second supply coils.

* * * * *